US006336722B1

(12) United States Patent
Wotton et al.

(10) Patent No.: US 6,336,722 B1
(45) Date of Patent: Jan. 8, 2002

(54) CONDUCTIVE HEATING OF PRINT MEDIA

(75) Inventors: Geoff Wotton, Battle Ground, WA (US); Angela Chen, Menlo Park, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/412,842

(22) Filed: Oct. 5, 1999

(51) Int. Cl.[7] ..... B41J 2/01
(52) U.S. Cl. ..... 347/102; 347/104; 347/105
(58) Field of Search ..... 347/102, 104, 347/105; 271/4.05, 4.06, 7

(56) References Cited

U.S. PATENT DOCUMENTS

| | | | | |
|---|---|---|---|---|
| 4,737,803 A | | 4/1988 | Fujimura | 346/140 R |
| 4,751,528 A | | 6/1988 | Spehrley, Jr. et al. | 347/18 |
| 4,878,071 A | | 10/1989 | Bibl | 346/153.1 |
| 4,926,199 A | | 5/1990 | Bibl et al. | 346/157 |
| 4,952,950 A | | 8/1990 | Bibl | 346/157 |
| 4,982,207 A | | 1/1991 | Tunmore et al. | 346/138 |
| 5,021,805 A | | 6/1991 | Imaizumi et al. | 347/187 |
| 5,124,728 A | * | 6/1992 | Denda | 346/134 |
| 5,287,123 A | | 2/1994 | Medin | 346/140 R |
| 5,296,873 A | | 3/1994 | Russell | 346/25 |
| 5,371,531 A | | 12/1994 | Rezanka | 347/43 |
| 5,406,321 A | | 4/1995 | Schwiebert | 347/102 |
| 5,428,384 A | | 6/1995 | Richtsmeier | 347/102 |
| 5,446,487 A | | 8/1995 | Russell | 347/102 |
| 5,467,119 A | | 11/1995 | Richtsmeier | 347/102 |
| 5,479,199 A | | 12/1995 | Moore | 347/102 |
| 5,500,667 A | | 3/1996 | Schwiebert | 347/102 |
| 5,510,822 A | | 4/1996 | Vincent et al. | 347/102 |
| 5,555,006 A | | 9/1996 | Cleveland | 347/41 |
| 5,589,866 A | | 12/1996 | Russell | 347/102 |
| 5,633,668 A | | 5/1997 | Schwiebert et al. | 347/102 |
| 5,650,808 A | | 7/1997 | Vincent | 347/43 |
| 5,668,584 A | | 9/1997 | Broder | 347/102 |
| 5,669,032 A | | 9/1997 | Islam | 396/579 |
| 5,717,446 A | | 2/1998 | Teumer et al. | 347/35 |
| 5,742,315 A | | 4/1998 | Szlucha | 347/102 |
| 5,754,208 A | | 5/1998 | Szlucha | 347/102 |
| 5,764,263 A | * | 6/1998 | Lin | 347/101 |
| 5,771,054 A | | 6/1998 | Dudek | 347/102 |
| 5,774,155 A | | 6/1998 | Medin | 347/102 |
| 5,896,154 A | | 4/1999 | Mitani | 347/102 |

FOREIGN PATENT DOCUMENTS

| | | |
|---|---|---|
| EP | 0598564 A3 | 5/1994 |
| EP | 0598564 A2 | 5/1994 |
| EP | 0875382 A2 | 11/1998 |
| EP | 0875382 A3 | 7/1999 |
| JP | 62288043 | 12/1987 |

OTHER PUBLICATIONS

European Search Report, Dec. 29, 2000.
The Examiner's attention is directed to commonly owned US Patent Applications Nos. 09/163,287; 09/163,275; 09/163,098; and 09/163,274—all filed Sep. 29, 1998.
Hall et al., Inkjet Printer Print Quality Enhancement Techniques, Feb. 1994 Hewlett Packard Journal, pp. 35–40.

* cited by examiner

*Primary Examiner*—John S. Hilten
*Assistant Examiner*—Minh H. Chau

(57) ABSTRACT

Heat is uniformly conducted to print media in an ink-jet printer in conjunction with the uniform application of vacuum pressure to the media for supporting the media as it is conveyed on a heated belt through the printer. The heat is applied to the media by conduction, in a manner that does not overheat the print head of the printer nor interfere with the trajectory of the droplets expelled from the print head. The heat is applied to the media in the print zone as well as regions on either side of the print zone where the media enters and exits the print zone. The amount of heat applied to each of these regions is independently controlled, and can be related to the physical characteristics of the particular type of print media or inks that are used.

28 Claims, 6 Drawing Sheets

CONDUCTIVE HEATING OF PRINT MEDIA

TECHNICAL FIELD

This invention relates to the heating of print media that is advanced through an ink-jet printer.

BACKGROUND AND SUMMARY OF THE INVENTION

An ink-jet printer includes at least one print cartridge that contains liquid ink within a reservoir. The reservoir is connected to a print head that is mounted to the body of the cartridge. The print head is controlled for ejecting minute droplets of ink from the print head to a print medium, such as paper, that is advanced through the printer.

Many ink-jet printers include a carriage for holding the print cartridge. The carriage is scanned across the width of the paper, and the ejection of the droplets onto the paper is controlled to form a swath of an image with each scan. Between carriage scans, the paper is advanced so that the next swath of the image may be printed.

Oftentimes, especially for color images, the carriage is scanned more than once across the same swath. With each such scan, a different combination of colors or droplet patterns may be printed until the complete swath of the image is formed. One reason for this multi-scan print mode is to enable the ink of one color to dry on the media before printing a second color pattern that abuts the first pattern. This print mode thus prevents color bleeding that might otherwise occur if two abutting, different-colored droplets were printed at the same time.

The speed with which the print media is moved through a printer is an important design consideration, called "throughput." Throughput is usually measured in the number of sheets of print media moved through the printer each minute. A high throughput is desirable. A printer designer, however, may not merely increase throughput without considering the effect of the increase on other print quality factors.

For instance, one important factor affecting the print quality of ink-jet printers is drying time. The print media movement must be controlled to ensure that the liquid ink dries properly once printed. If, for example, sheets of printed media are allowed to contact one another before ink is adequately dried, smearing can occur as a result of that contact. Thus, the throughput of a printer may be limited to avoid contact until the sheets are sufficiently dry. This potential for smearing is present irrespective of whether ink is applied by a scanning technique as discussed above or by other methods, such as stationary print head arrangements that effectively cover an entire width of the print media.

Scanning type ink-jet printers must have their throughput controlled so that separate scans of the carriage are spaced in time by an amount sufficient to ensure that no color bleeding occurs as mentioned above.

In addition to throughput, an ink-jet printer designer must be concerned with the problem of cockle. Cockle is the term used to designate the uncontrolled, localized warping of absorbent print media (such as paper) that occurs as the liquid ink saturates the fibers of the paper, causing the fibers to swell. The uncontrolled warping causes the paper to move toward or away from the print head, changing both the distance and angle between the print head and the paper. These unpredictable variations in distance and angle reduce print quality. A predictable and constant distance and angle are desired to assure high print quality. Even if the occurrence of cockle does not affect this aspect of print quality, the resultant appearance of wrinkled print media is undesirable.

Heat may be applied to the print media in order to speed the drying time of the ink. Heat must be applied carefully, however, to avoid the introduction of other problems. For example, if the heat is not uniformly applied to the printed media, the resultant uneven drying time of a colored area of an image can produce undesirable variations in the color's hue characteristic.

Another problem attributable to improperly applied heat can be referred to as "buckling." Normally, print media carries at least some moisture with it. For example, a sealed ream of standard office paper comprises about four and one-half percent moisture. High amounts of moisture in the media, such as paper, may be present in humid environments. As heat is applied to part of the paper, uneven drying and shrinkage occurs. The uneven shrinkage causes the paper to buckle in places, which undesirably varies the distance between the paper and the print head, as occurs with the cockle problem mentioned above.

Some print media, such as polyester-based transparency print media, will carry insignificant amounts of water and, therefore, will not buckle as a result of uneven shrinkage. Such media, however, may buckle if all or portions of it are overheated. Thus, uniform, controlled heating of the media is important for high print quality, irrespective of the type of print media.

If heat is applied to the media, it is useful to have it applied in the print zone of the printer. The print zone is the space in the printer where the ink is moved from the print head to the print media. Thus, the media is moved through the print zone during a printing operation. Heating the media in the print zone rapidly drives off (evaporates) a good portion of the liquid component of the ink so that cockle is unable to form, or at least is minimized, and so that the time between successive scans of the same swath can be minimized.

When one attempts to heat the media in the print zone, it is important to ensure that the applied heat is not directed to the print head of the cartridge. If the print head overheats, droplet trajectory and other characteristics of the print head can change, which reduces print quality. Also, the heat should not be applied in a way (as by convection) that may directly alter the droplet trajectory. The heat should be applied in a cost-efficient manner.

Another printer design consideration involves the support of media in the printer for precise relative positioning and movement relative to the print head of the cartridge. Vacuum pressure may be used to support print media for rapid advancement through the printer. One method of supporting a sheet of print media is to direct it against an outside surface of a moving carrier such as a perforated drum or porous belt. Vacuum pressure is applied to the interior of the carrier for holding the sheet against the moving carrier. The carrier is arranged to move the sheet through the print zone.

The vacuum pressure or suction (Here the term "vacuum" is used in the sense of a pressure less than ambient, although not an absolute vacuum.) must be applied at a level sufficient for ensuring that the sheet of print media remains in contact with the carrier. Moreover, a uniform application of vacuum pressure to the media will help to eliminate the occurrence of cockle in the sheet because the vacuum pressure helps overcome the tendency of the media fibers to warp away from the surface of the carrier that supports the media.

With the foregoing in mind, the present invention may be generally considered as a technique for heating print media in an ink-jet printer. As one aspect of this invention, heat is uniformly applied to the media in conjunction with mechanisms for uniformly applying vacuum pressure to the media for supporting the media as it moves through the printer.

The heat is efficiently applied to the media by conduction, in a manner that will not overheat the print cartridge print head nor interfere with the trajectory of the droplets expelled from the print head. The hardware for applying the heat has high thermal transfer efficiency and low thermal mass. As a result, there is less likelihood of overheating the print cartridge or other printer components through heat radiation from the heating components after the paper is moved from the print zone.

In a preferred embodiment, the heat is applied to the media in the print zone as well as regions on either side of the print zone, where the media respectively enters and exits the print zone. The entry region is sized and heated by an amount that ensures that media is sufficiently dry before entering the print zone so that shrinkage and buckling does not occur in the print zone, thus ensuring that a constant distance and angle is maintained between the media and the print head.

The amount of heat applied to each of the entry and exit regions and to the print zone is independently controlled. The amount of heat applied can be related to the physical characteristics of the particular type of print media or inks that are used, or the ink densities of the image being printed. Also, the thermal transfer efficiency of the heater mechanisms provides a quick temperature rise time so that the paper can be heated quickly, thus permitting high throughput.

Other advantages and features of the present invention will become clear upon review of the following portions of this specification and the drawings.

DETAILED DESCRIPTION OF PREFERRED EMBODIMENTS

Figure 1:
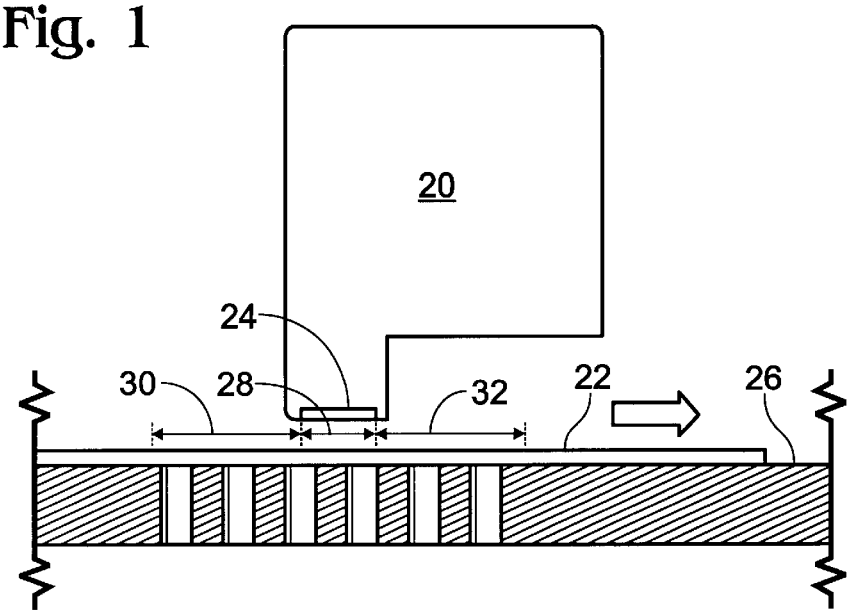
FIG. 1 is a diagram showing the primary components of an ink-jet printer that may be adapted for conductive heating of print media in accordance with the present invention.

The diagram of FIG. 1 shows an ink-jet print cartridge 20, which may be mounted to a printer by conventional means such as a movable carriage assembly (not shown). For illustrative purposes, only one cartridge is shown in the figures, although it is contemplated that more than one cartridge may be employed. For instance, some color printers use four cartridges at a time, each cartridge carrying a particular color of ink, such as black, cyan, yellow, and magenta. In the present description, the term "cartridge" is intended to mean any such device for storing liquid ink and for printing droplets of the ink to media. Preferred cartridges are available from Hewlett Packard Co. of Palo Alto, Calif., http://www.hp.com. The cartridges may be connected to remote sources of ink that supplement the ink supply that is stored in each cartridge.

The carriage assembly supports the cartridge 20 above print media, such as a sheet of paper 22. A print head 24 is attached to the underside of the cartridge. The print head 24 is a planar member and has an array of nozzles through which the ink droplets are ejected. The cartridge 20 is supported so that the print head is precisely maintained at a desired spacing from the paper 22, such as, for example, between 0.5 mm to 1.5 mm from the paper. Also, the array of nozzles in the print head is maintained in substantially parallel relationship with the portion of the paper 22 underlying the print head.

The paper 22 is advanced though the printer, and the cartridge print head 24 is controlled to expel ink droplets to form an image on the paper. In the vicinity of the cartridge 20, the paper 22 is supported on a support surface of a moving carrier 26, such as a drum or conveyor belt. A flat carrier is shown in FIG. 1. A drum-type carrier would, of course, appear curved. The carrier 26 moves the paper 22 through the printer's print zone 28. As noted above, the print zone 28 is the space in the printer where the ink is moved from the print head 24 to the paper 22. Two imaginary boundaries of the print zone 28 are shown in dashed lines in FIG. 1.

For the purposes of this description, one can consider the space that is adjacent to the print zone (to the left in FIG. 1) as an entry zone 30 through which the paper 22 is conveyed before entering the print zone 28. The space that is on the opposite side of the print zone is the exit zone 32, through which the paper is conveyed as it passes out of the print zone 28 on its way to a collection tray or the like.

In accordance with the present invention there is hereafter described a technique for heating the paper 22 as it is moved through the printer. Heat is uniformly applied to the paper in conjunction with mechanisms for uniformly applying vacuum pressure to the paper (or any other media) to support the paper as it moves through the printer.

Preferably, the heat is applied to the paper 22 while the paper is in the print zone 28. Also provided are mechanisms for heating the paper as it moves through the entry zone 28 and the exit zone 32.

Figure 2:
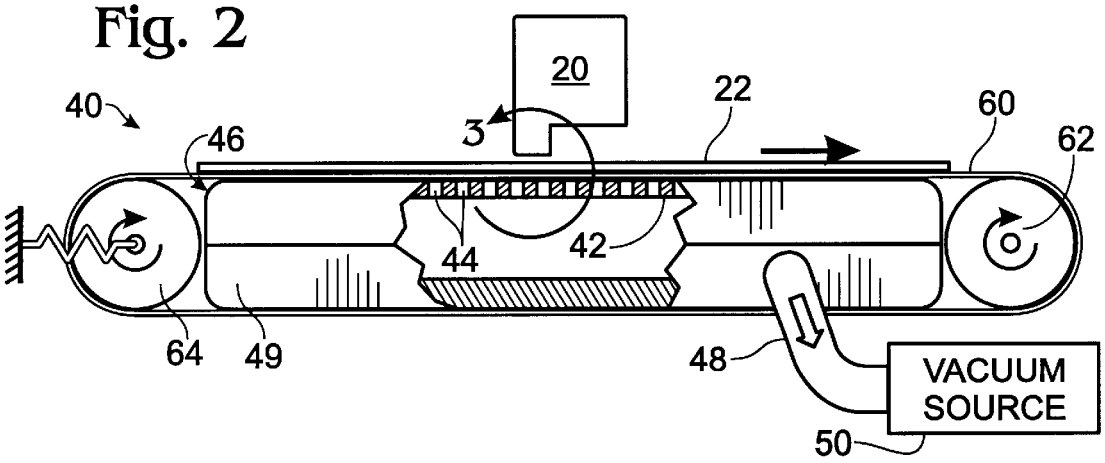
FIG. 2 is a diagram showing a preferred embodiment of the present invention, including mechanisms for heating and supporting print media in an ink-jet printer.
Figure 3:
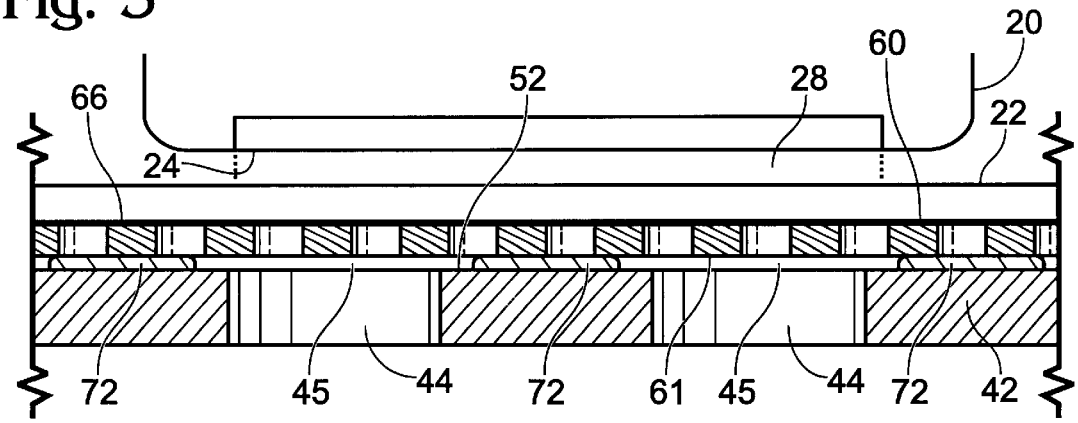
FIG. 3 is an enlarged detail view of a portion of the preferred embodiment of FIG. 2.
Figure 4:
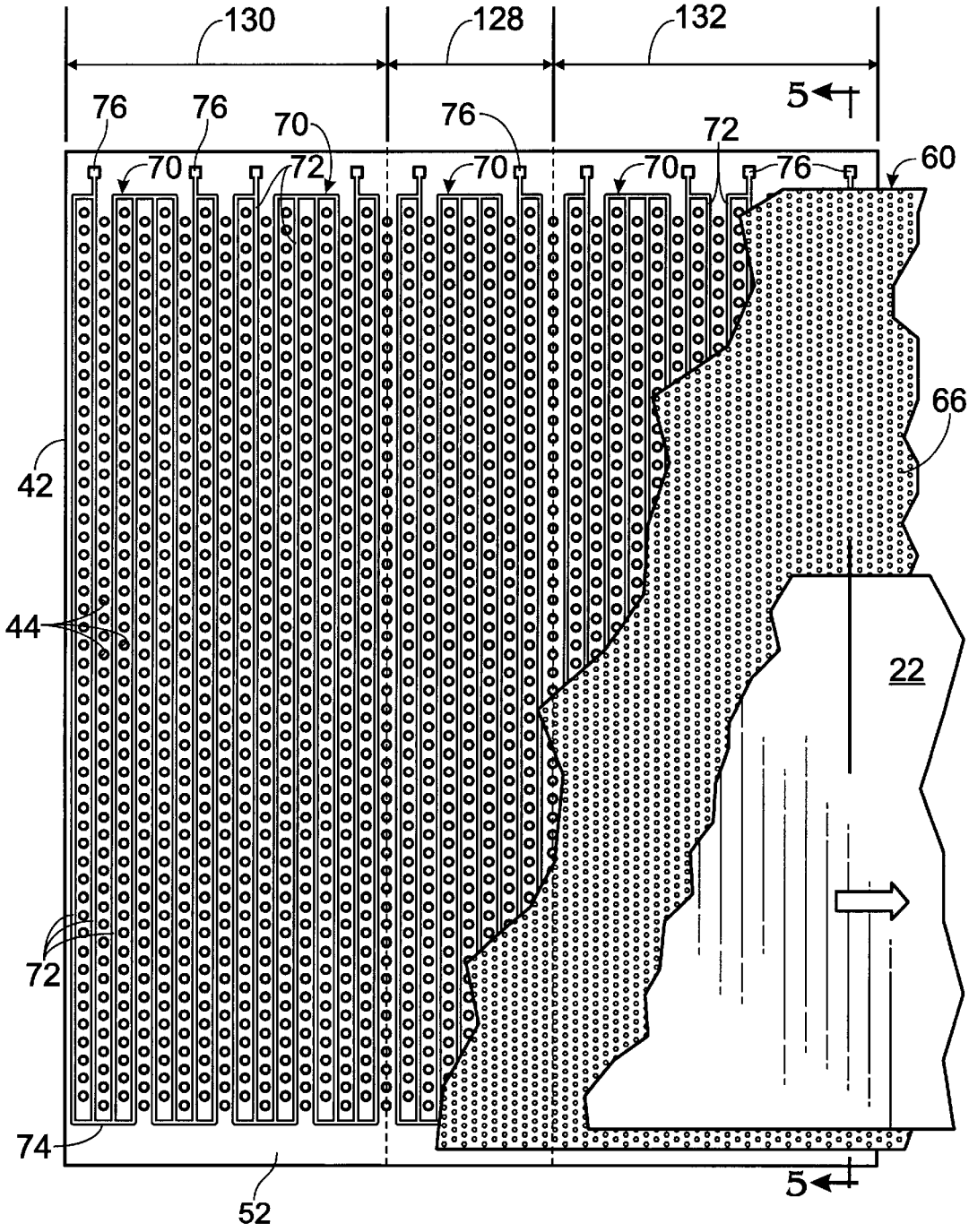
FIG. 4 is a top plan view of mechanisms for supporting and heating the print media in the printer.

With particular reference to FIGS. 2–4, a preferred embodiment of the present invention includes a media handling system 40 for heating and supporting the media in an ink-jet printer. The system includes a platen 42 that generally provides support for media, such as paper sheets 22, that are directed through the print zone of the printer.

The platen 42 is a rigid member, formed of a heat conductive material such as stainless steel. In this embodiment, vacuum pressure is employed for drawing the paper against the platen to support the paper as it is advanced through the printer. Thus, the platen 42 has ports 44 formed through it. The platen 42 also forms the top of a vacuum chamber or box 46 that is inside the printer.

The vacuum box 46 includes a body 49 to which the platen 42 is attached. The box 46 is thus enclosed but for the ports 44 in the platen 42 and a conduit 48 to a vacuum source 50. The vacuum source is controlled to reduce the pressure in the interior of the box 46 so that suction or vacuum pressure is generated at the ports 44.

The platen 42 has a planar support surface 52 (FIG. 3) that faces the print head 24. The ports 44 in the platen open to the support surface 52. As best shown in FIG. 4, the ports are preferably formed in uniform rows across the support surface. The ports 44 are sized and arranged to ensure that vacuum pressure is uniformly distributed over the platen surface 52. In a preferred embodiment, the ports are circular where they open to the surface 52. The circles are 3.0 mm in diameter and spaced apart by 6.0 mm to 6.25 mm. This arrangement of ports thereby provides a platen support surface having more than 33% of its area covered with vacuum ports. Of course, other port sizes and configurations can be used to arrive at an equivalent distribution of ports over the support surface of the platen.

The ports 44 of the platen communicate vacuum pressure to whatever is supported on the support surface. For instance, if the platen were part of a rotating drum or carousel, sheets of paper could be loaded directly onto the platen support surface 52 and moved by the rotating drum through the print zone 28 as the vacuum pressure secures the paper to the platen. The paper in such a system could be heated in accordance with the present invention as described below. A preferred embodiment of the invention, however, contemplates a stationary platen used in combination with a porous transport belt for moving the paper through the print zone as described next.

A suitable transport belt 60 is configured as an endless loop between a fixed drive roller 62 and tension roller 64 (FIG. 2). In the figures, the belt 60 is shown rotating clockwise, with a transport portion 66 of the belt (FIG. 3) sliding over the support surface 52 of the platen 42. The return portion of the belt 60 underlies the vacuum box 46. Paper 22 is directed onto the transport portion by conventional pick and feed roller mechanisms (not shown).

The belt 60 conducts heat to the paper 22 (or other type of print media) that is carried on its transport portion 66. Moreover, the belt permits a uniform communication of vacuum pressure to the underside of the paper 22. To this end, the belt is porous and made of heat conductive material.

In a preferred embodiment the belt is formed of a stainless steel alloy, commonly known as Invar, which resists buckling, having a thickness of about 0.125 mm. The belt 60 has a width that is sufficient to cover all but the margins of the platen 42 (FIG. 4). The belt 60 is heated by conduction. In one preferred embodiment, the conductive heating of the belt is accomplished by the use of heaters 70 that are attached to the support surface 52 of the platen 42 as best shown in FIG. 4.

The heaters 70 are comprised of an array of linear, resistive heating elements 72 (preferably, eight elements 72 for each heater 70). The heating elements 72 extend between the rows of vacuum ports 44 that are defined on the support surface 52 of the platen. At the edges of the support surface 52 the individual elements 72 are joined (as at reference numeral 74) and the termini of the heaters are enlarged into two contact pads 76 for connecting to a current source and ground as explained more below.

The heaters 70 are arranged so that one heater, a "print region heater," resides on the central portion of the platen 42 immediately underlying the print zone 28. As shown in FIG. 4, the region on the platen support surface underlying the print zone is designated with the reference number 128 and is hereafter referred to as the print region 128 of the platen. Thus, in addition to a uniform distribution of vacuum ports 44 in the print region 128, the platen is configured to have a uniform distribution of heating elements 72 for uniform application of heat to the paper 22. In particular, a heating element 72 is located to extend between each row of ports 44.

In the embodiment depicted in FIG. 4, there are also two heaters 70 in the entry region 130 of the platen surface (that region corresponding to the above-described entry zone 30). These heaters will be referred to as the entry region heaters. Similarly, two "exit region heaters" are provided in the exit region 132 of the platen surface (the region corresponding to the above-described exit zone 32.) Thus, in this embodiment, twice as much platen support surface area is heated in the entry region 130 or exit region 132 as compared to print region 128.

The heaters 70 are of the thick-film type. The heaters include a ceramic base layer that is silk-screened onto the support surface 52 of the platen in the pattern depicted in FIG. 4. Resistive paste layers are then deposited between vitreous dielectric layers, which are dried and fired to produce an integrated heating element 72. The heating elements 72 are about 1.5 mm wide (as measured left to right in FIG. 3) and protrude slightly above the support surface 52 as shown (although exaggerated) in FIG. 3. In a preferred embodiment, the heating elements 72 protrude by about 0.05 to 0.10 mm above the support surface 52 of the platen 42.

The underside 61 of the transport belt 60 slides over the top surfaces of the heating elements 72 as the belt is driven to move paper 22 through the print zone. Preferably, the underside of the belt is thinly coated with a layer of low-friction material, such as Dupont's polytetrafluoroethylene sold under the trademark Teflon.

The protruding heating elements 72 are advantageously employed for distributing the vacuum pressure that is communicated to the belt 60 via the ports 44 in the platen. As can be seen in FIG. 3, the space between adjacent heating elements 72 and between the belt 60 and support surface 52 of the platen defines an elongated channel 45 that is continuous with the each port in a row of ports 44. Thus, each channel 45 distributes vacuum pressure across the entire width of the porous belt 60.

Figure 5:
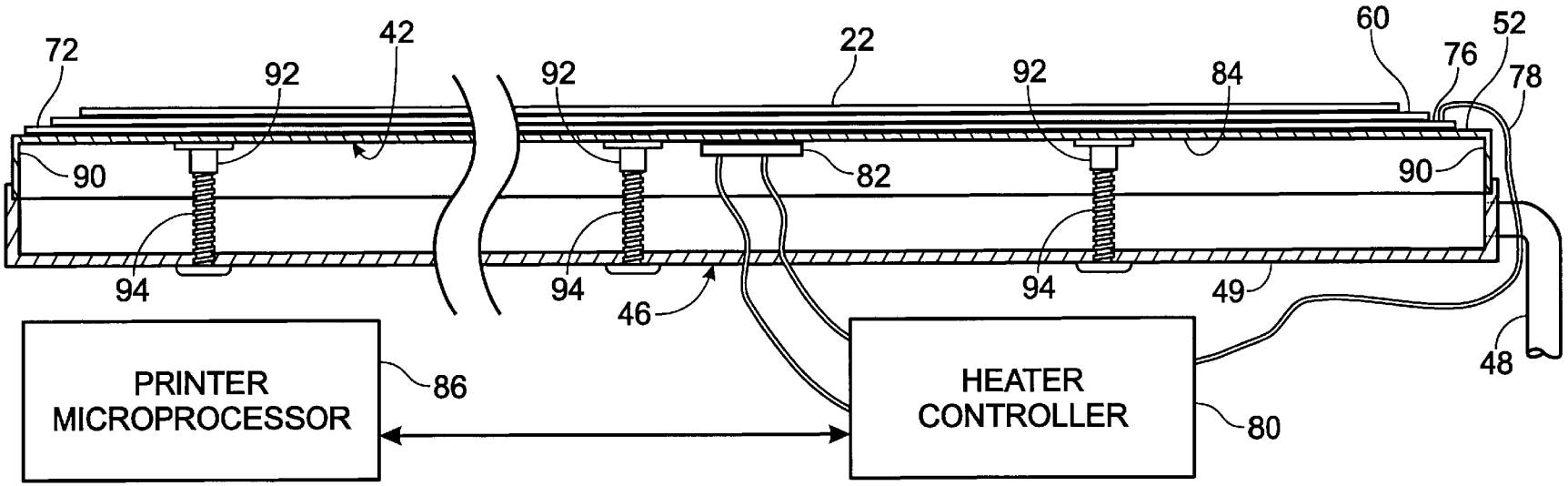
FIG. 5 is a section view taken along line 5—5 of FIG. 4.

As depicted in FIG. 5, the contact pads 76 of each heater 70 are connected, as by leads 78, to a heater controller 80. In a preferred embodiment, the heater controller 80 is connected to at least three temperature sensors 82 (only one of which appears in FIG. 5). One sensor is attached to the undersurface 84 of the platen, centered in the print region 128 and between a row of ports. The other two sensors are similarly located to underlie, respectively, the entry region 130 of the platen surface and the exit region 132 of the platen surface. The sensors 82, which can be embodied as thermistors, provide to the heater controller 80 an output signal that is indicative of the temperature of the platen. The heater controller 80 is also provided with control signals from the printer microprocessor 86. (For illustrative purposes, the heater controller is shown as a discrete component, although such heater control may be incorporated into the overall printer control system.) Such signals may provide an indication of the type of media about to be printed.

The heater controller 80 identifies the corresponding range of temperatures that should be read on the sensors 82 to ensure that an optimal amount of heat is being applied to the given type of media in the region corresponding to that sensor. The corresponding heater 70 is then driven with the appropriate current for achieving the correct sensor temperature. In one preferred embodiment, the heater in the print region 128 is normally driven by a current sufficient to establish a temperature of about 150° C. at the transport portion 66 of the belt, which contacts the paper 22.

The identification of the desired temperature range can be carried out, for example, by resort to a look-up table stored in read only memory (ROM) of the heater controller 80 and that is made up of an empirically derived range of temperatures correlated to many different media types. For instance, if the printer operator selects a transparency-type of print media, the range of temperatures to be detected on sensor 82 in the print region 128 of the platen (hence applied via conduction to the media) would likely be lower than such temperatures for paper media.

Irrespective of the relative size of the heated entry, print, and exit regions, it is desirable to control those heaters separately from one another. To this end, separate control leads are provided from the heater controller 80 to the contact pads 76 of the heaters 70 located in each surface region. The separate control of the heating regions affords a degree of customization for heating the print media, depending, for example, on the physical characteristics of the media used.

For instance, if the printer operator employs transparency-type media (which contains practically no moisture), the heater(s) in the entry region 130 may be controlled to provide little or no heat, although the heaters in the print region 128 and exit region would be operated to dry the ink as soon as it is applied.

As another example, the amount of heat applied to the print media 22 by the exit region heaters may be boosted relative to the entry region or print region heaters in instances where the printer microprocessor 86 provides to the heater controller 80 a control signal indicating that a particularly large amount of ink is to be printed onto the media sheet that next reaches the platen. The extra heat in the exit region 132 would facilitate timely drying of the large amount of ink.

FIG. 5 depicts one method for assembling a vacuum box 46 using a platen 42 as described above. Preferably the portion of the platen 42 that defines the entry region 130, print region 128, and exit region 132 is a separate module that is fastened to the body 49 of the vacuum box. This module also defines the support surface 52 and is formed from flat stainless steel of about 1.0 mm thick. At the edge of the module, there are integrally attached flanges 90 that extend downwardly, perpendicular to the surface 52. The flanges are joined at each comer of the module and provide stiffening support to the plate surface to ensure that the surface does not bend out of its plane. This helps to ensure that the distance between the print head 24 and paper 22 that is carried by the support surface remains constant even as the platen is heated and cooled.

The lowermost edges of the flanges 90 seat in correspondingly shaped grooves formed in the vacuum box body 49. A gasket is provided to seal this junction. The undersurface 84 of the platen 42 also includes a number of evenly spaced, internally threaded studs 92. Three studs appear in FIG. 5. The studs receive the threaded shafts of fasteners 94 that pass through the vacuum box body 49 to thus fasten together the platen 42 and the body 49.

As an alternative, the platen comprising the support surface may be formed of a thin sheet of ceramic material to provide a robust platen as respects, especially, the ability of the platen to maintain its planar shape despite heating and cooling cycles. Flanges, configured as those appearing at 90 in FIG. 5 and formed of thermally insulating material, are used in this embodiment as support for the ceramic surface and to maintain spacing to define the vacuum box underlying the platen.

The platen 42, including the entry, print, and exit regions, may be sized to define the entire support surface that underlies the transport portion 66 of the belt 60. Alternatively, this platen module may be attached to the valve box body between non-heated extensions of the platen surface that may or may not include vacuum ports (and associated fluid communication with the interior of the box 46) for securing the media, depending primarily upon the physical characteristics of the media that is accommodated by the printer.

Figure 6:
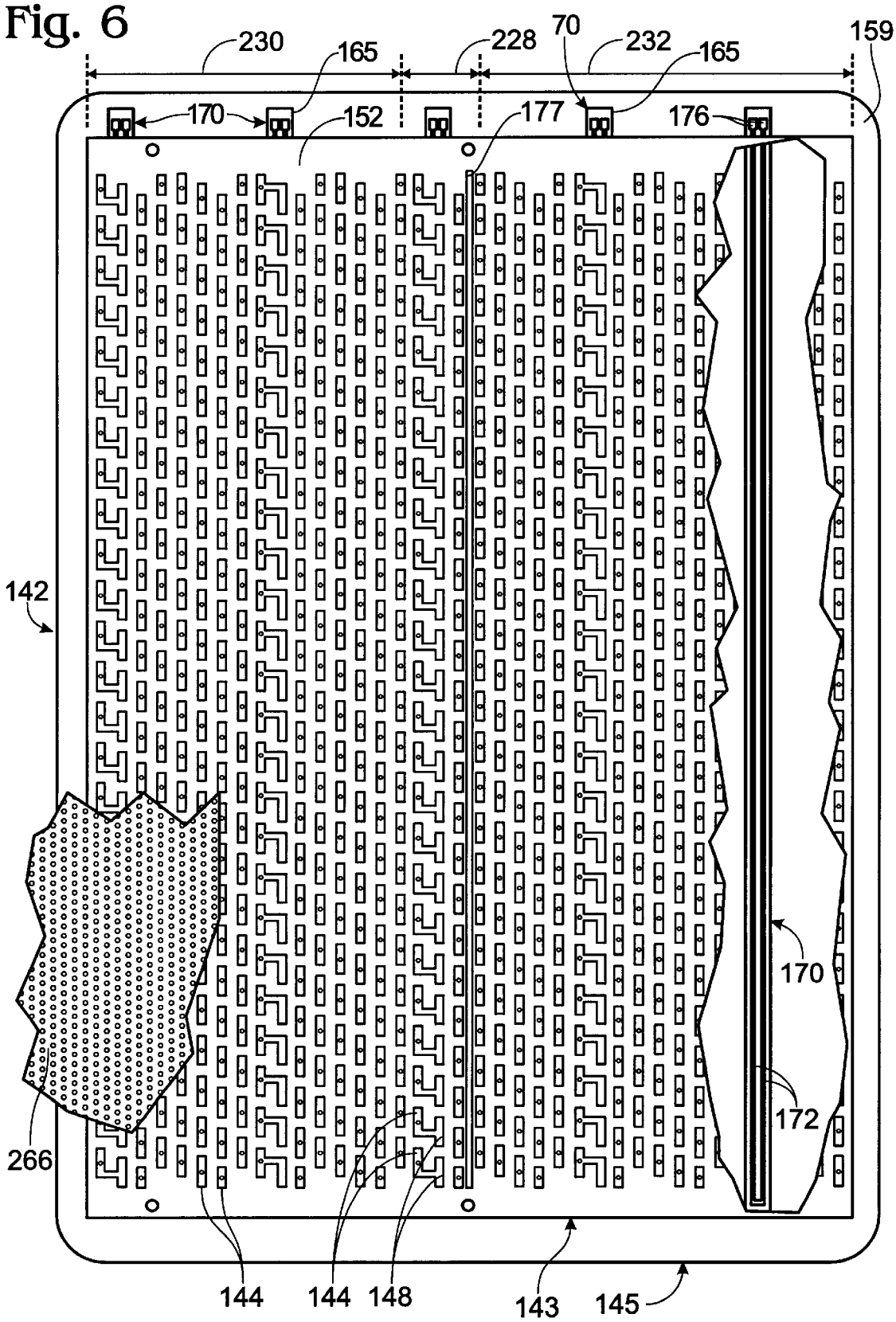
FIG. 6 is a top plan view of another preferred embodiment of the present invention.
Figure 7:
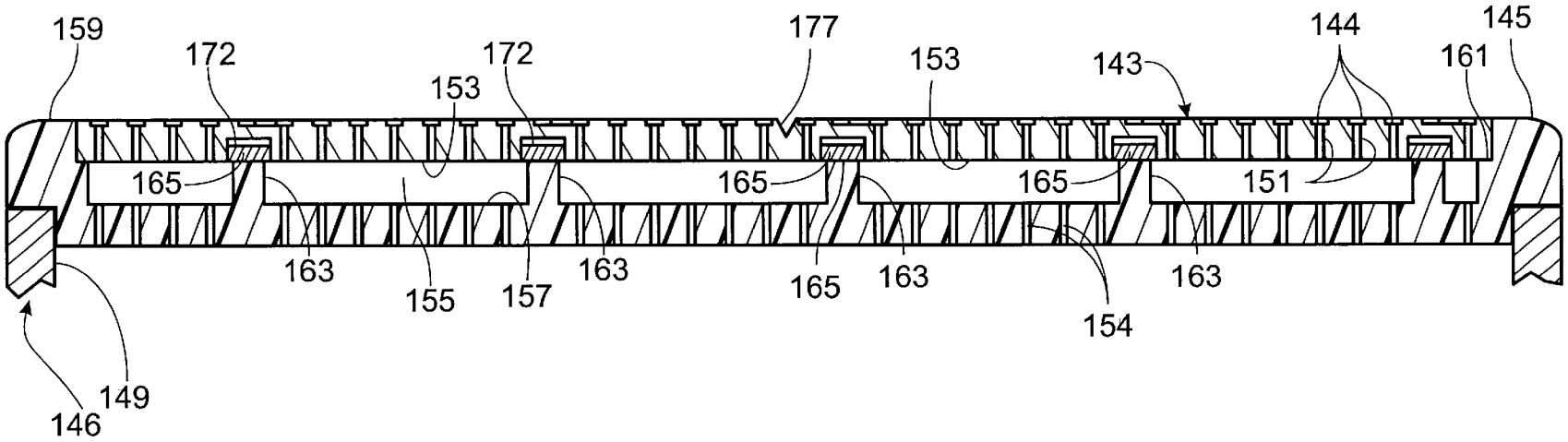
FIG. 7 is a cross sectional view of the embodiment of FIG. 6.

It will be appreciated that a number of other platen configurations may be employed for uniformly heating and supporting print media in accord with the present invention. One alternative embodiment is depicted in FIGS. 6 and 7. Those figures show a platen 142 that, like platen 42 in the earlier described embodiment, forms the top of a vacuum chamber or box that is inside the printer. In this regard, the cross section of FIG. 7 shows the body 149 of a vacuum box 146 that matches the box 46 described earlier in that the box 146 is enclosed but for ports 144 in the platen 142, and a conduit to a vacuum source (not shown). The vacuum source is controlled to reduce the pressure in the interior of the box 146 so that suction or vacuum pressure is generated at the ports 144.

The platen 142 of this embodiment includes two parts: a rigid top plate 143 that mates with a bottom plate 145. The top plate 143 is formed of a heat conductive material such as an aluminum alloy or copper and includes a planar support surface 152 that faces the print head 24. The ports 144 in the platen top plate open to the support surface 152. As best shown in FIG. 6, the ports 144 are preferably formed in uniform rows across the support surface. The ports 144 are sized and arranged to ensure that vacuum pressure is uniformly distributed over the platen surface 152. In this embodiment the ports are rectangular where they open to the surface 152, There the ports are 2.0 mm wide and 6.0 mm long. The ports 144 are aligned with their short sides being parallel to the direction of paper movement over the platen 142 (left to right in FIG. 6).

Each row of ports 144 is closely spaced relative to an adjacent row, thereby to ensure uniform distribution of vacuum pressure at the support surface 152 of the platen 142. In a preferred embodiment, the space between adjacent rows of ports is 2.0 mm, preferably no larger than 3.0 mm. Put another way, the space between the rows is no larger than on and one-half times the width of the ports. Of course, other port sizes and configurations can be used to arrive at an equivalent distribution of ports over the support surface 152 of the platen 142.

Apertures 151 are formed through the top plate 143 of the platen 142, one aperture for each port 144. These apertures extend from the base of the rectangular portion of the port to the underside 153 of the platen top plate. An air space 155 is defined beneath that underside 153 and the upper surface 157 of the bottom plate 145 of the platen, as will be explained more below.

The bottom plate 145 of the platen 142 is formed of rigid, high-temperature plastic such as the polyetherimide sold by General Electric under the trademark Ultem. In a preferred embodiment the bottom plate includes a peripheral frame 159 that surrounds the top plate 143 and includes a groove 161 into which fits the edge of the top plate (FIG. 7). The otherwise flat upper surface 157 of the bottom plate is interrupted with an array of cylindrical heater support posts 163 that project upwardly from the surface 157, Those posts are evenly spaced in an array of seven rows and five columns across the area of the bottom plate (one row of posts being depicted in FIG. 7).

The upper ends of each column of support posts 163 are bonded to the underside of an elongated substrate 165 that is part of a heater 170. In this embodiment, there are five such heaters 170. The heaters fit into correspondingly shaped grooves that are formed in the underside 153 of the platen 142 at spaced-apart locations across the width of the platen 142 as shown in FIG. 6.

The substrate of each heater is comprised of ceramic material. Upon the substrate is attached a resistive heating element 172 (FIG. 7), preferably formed of conventional thick-film resistive paste. The heating elements are terminated in contact pads 176 (FIG. 6), which, like the pads 76 of the earlier described embodiment permit the individual heaters to connect with and be controlled by a heater controller as explained above.

One of the heaters 170 underlies the print region 228 (which functionally corresponds to the print region 128 of the earlier embodiment) in the platen surface 152, as shown in FIG. 6. In this regard, the posts 163 are sized so that the heating elements 172 of the heaters are pressed against the heat conductive top plate 143 so that heat is conducted through the top plate and to the transport portion 266 (FIG. 6) of a transport belt 260 that matches the construction of the above described transport belt 60.

In this embodiment, the belt 260 is driven to slide directly across and in contact with the support surface 152 of the platen 142 (that is, the heaters 170 are remote from, and thus do not protrude from, that support surface). Both the belt 260 and the support surface 152 are thus thinly coated with a layer of low-friction material, such as Dupont's polytetrafluoroethylene sold under the trademark Teflon.

As was the case in the earlier embodiment, a pair of heaters 170 are attached to the platen adjacent to an entry region 230 of the support surface 152, and another pair of heaters 170 are attached to the platen adjacent to an exit region 230 of that surface. As before, these heaters are separately controlled.

It is also contemplated that the heaters of one region may be somewhat isolated from the heater(s) of another region. In this regard, FIGS. 6 and 7 depict an example of a restriction or notch 177 formed in the surface of the platen to limit the conduction of heat through the platen between the print region 228 and the exit region 232. This restriction limits or chokes the transfer of heat through the platen cross section at the notch since the cross section there is much reduced relative to the remainder of the platen. As a result, most of the heat generated by an operating print region heater will not flow into the adjacent exit region 232. Such a restriction is useful where, for example, print quality requirements are such that the exit region heaters should be substantially cooler than the print zone heater.

The bottom plate 145 also includes through apertures 154 that are axially aligned with the apertures 154 in the top plate 143. As a result, the vacuum pressure developed in the vacuum box 149 is communicated though the bottom plate apertures 154, through the air space 155, through the top plate apertures 151 to the ports 144 on the surface of the platen. Thus, the uniform distribution of vacuum pressure is present across the platen support surface 152.

It is noteworthy that no top plate apertures 151 are provided in the platen above the heaters 170. In these locations, vacuum port extensions 148 are provided in the surface 152. These extensions 248 are recesses formed in the surface 252 to extend from a port 144 (which has a connecting aperture 151) to the surface area overlying the heater so that the vacuum pressure provided to the connected port 144 is distributed via the extensions 148 to the surface area over the heaters 270. This permits the uniform distribution of the pressure over the entire platen support surface 252.

Figure 8:
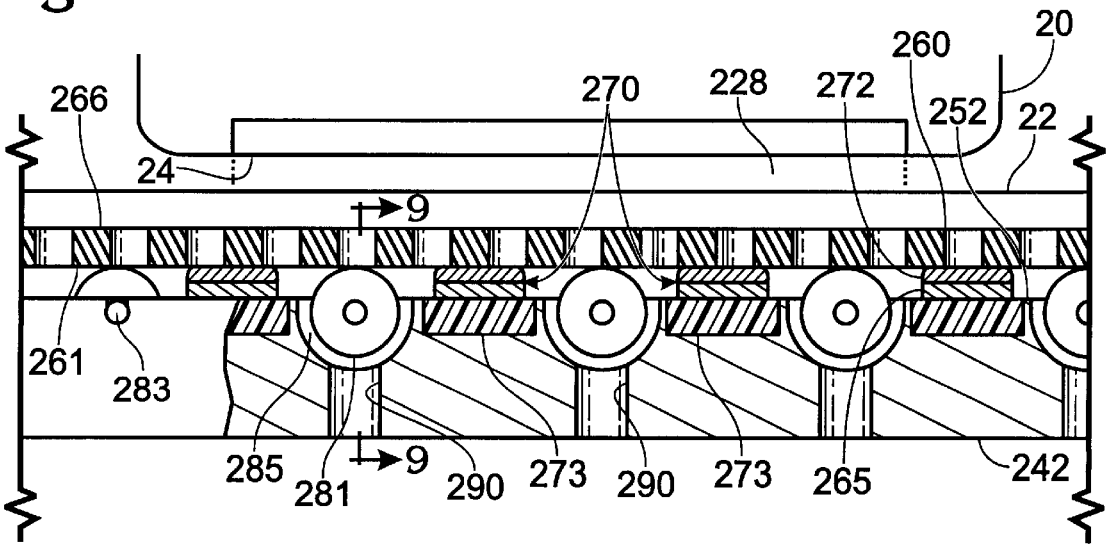
FIG. 8 is a cross section view of another preferred embodiment of the present invention, showing heaters and rollers for respectively heating and facilitating movement of the print media.
Figure 9:
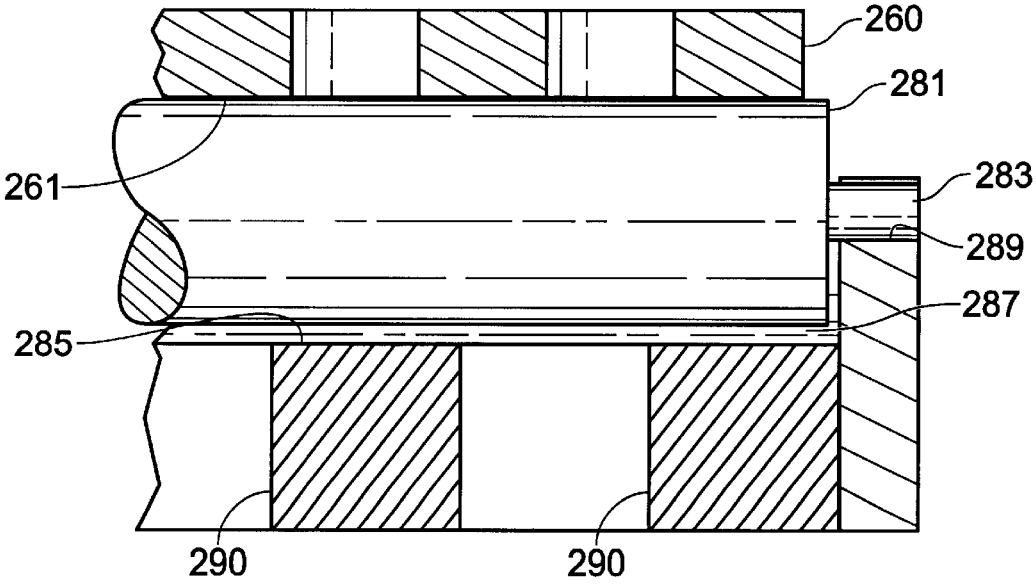
FIG. 9 is a detail view of a portion of a roller that is part of the embodiment of FIG. 8.

The embodiment of FIGS. 8–9 is primarily directed to conductive heating of the heat conductive belt 260 (which generally matches the belt 60 of the earlier described embodiment) while supporting the belt above the surface 252 of the platen 242, thereby to minimize friction between the belt and platen. In this embodiment, heaters 270, which are constructed like those heaters 170 of the embodiment of FIGS. 6 and 7, are mounted to spaced-apart pads 273 of rigid, high-temperature plastic such as the polyetherimide sold by General Electric under the trademark Ultem. These heater support pads 273 are located in grooves formed in the support surface 252 of the platen that extend in a direction perpendicular to the direction of movement of media through the print zone.

Alternative structures for supporting the heaters include elongated strips that fill the bottom of the grooves and have upwardly protruding, thin edges that support the heater and thus include between those edges a thermally insulating air gap. This structure, as well as the foregoing pads 273, may be formed of open-cell silicon foam, for more insulating effect. This foam could also be applied between the pads 273 or to fill the just described air gap.

The substrate 265 and heating element 272 of each heater are stacked onto the support strip. The uppermost surface of the heater 270 protrudes above the support surface 252 and contacts the underside 261 of the heat conductive belt.

Support members are mounted to the platen at closely spaced locations along the support surface 252. In a preferred embodiment, the support members are elongated, cylindrical rollers 281 that extend between each heater 270. As best shown in FIG. 9, the lower half of each roller fits in a correspondingly shaped, semi-cylindrical recess 285 made in the support surface 252 of the platen. The recess 285 is slightly larger that the roller 281, thus a gap 287 is present around the outer surface of the roller.

The ends of each roller are formed into a small diameter spindle 283 that fits into a slot 289 made in the surface 252 at opposite ends of each recess. Preferably, the opening of the slot 289 at the surface 252 is slightly narrower than the diameter of the spindle so that the spindle can be snap fit into the slot, free to rotate in the slot, but not able to move out of the slot in the absence of a sufficient force applied to remove the roller.

The upper sides of the rollers 281 provide rolling support for the belt 260 as it is driven across the platen in contact with the heaters 270. It will be appreciated that the embodiment depicted in FIGS. 8 and 9 provides an enhanced low-friction approach to moving the belt relative to the platen. Moreover, the uniform distribution of vacuum pressure to the belt is also provided in this embodiment.

Specifically, each gap 287 that surrounds a roller 281 has a number of spaced-apart apertures 290 opening to it. Each aperture 290 communicates with the vacuum pressure developed in the vacuum box that underlies the platen. As a result, the gaps 287 serve as vacuum ports in the support surface of the platen, thereby to facilitate the uniform distribution of vacuum pressure to the transport belt 260.

Although preferred and alternative embodiments of the present invention have been described, it will be appreciated by one of ordinary skill that the spirit and scope of the invention is not limited to those embodiments, but extend to the various modifications and equivalents as defined in the appended claims.

What is claimed is:

1. An apparatus for heating print media in a printer that has a print zone where ink is applied to print media, comprising:

a platen mounted to the printer and having a support surface upon which print media may be supported, the support surface having a print region in the print zone, wherein the print region of the support surface is configured to have vacuum ports thereon;

a heater attached to the platen for conducting heat to the print region; and a porous transport belt comprising heat conductive material and covering the platen support surface to support and move print media through the print zone and for conducting heat from the heater to the print media that is supported by the belt.

2. The apparatus of claim 1 wherein the heater includes heating elements located adjacent to the print region of the platen support surface.

3. The apparatus of claim 1 wherein the print region of the support surface is configured to have a uniform distribution of vacuum ports.

4. The apparatus of claim 3 wherein the heater is attached to the support surface and extends between rows of the uniformly distributed vacuum ports.

5. The apparatus of claim 1 including a vacuum chamber connected for fluid communication with the vacuum ports of the platen thereby to apply vacuum pressure to the porous transport belt.

6. The apparatus of claim 5 wherein the heater includes heating elements that project from the platen support surface, thereby to facilitate distribution of the vacuum pressure that is applied to the transport belt.

7. The apparatus of claim 1 further comprising an entry heater located adjacent to the print region of the platen support surface on one side of the print zone thereby to conduct heat to print media that is on the support surface outside of the print zone.

8. The apparatus of claim 7 further comprising an exit heater located adjacent to the print region of the platen support surface on a second side of the print zone thereby to conduct heat to print media that is on the support surface outside of the print zone.

9. Apparatus of claim 8 wherein at least one of the entry and exit heaters is controlled independently of the heater that is within the print zone.

10. The apparatus of claim 1 wherein the vacuum ports are sized and arranged so that more than 33% of the area of the print region of the support surface comprises vacuum ports.

11. The apparatus of claim 10 wherein the heater includes heating elements located adjacent to the print region of the platen support surface.

12. The apparatus of claim 11 wherein the heating elements are attached to the print region of the support surface and extend between vacuum ports.

13. The apparatus of claim 1 wherein the heater is mounted to protrude from the support surface, the transport belt covering the heater.

14. The apparatus of claim 13 including support members extending between the belt and the support surface for supporting the belt above the support surface at locations away from the protruding heater.

15. The apparatus of claim 13 wherein the belt is comprised of stainless steel having a thickness of about 0.125 mm.

16. The apparatus of claim 1 including a second heater mounted to the platen and connected for control that is independent of the heater of claim 1.

17. The apparatus of claim 16 further comprising a restriction formed in the platen for restricting conduction of heat through the platen between the two heaters.

18. A method of heating print media that is advanced through an ink-jet printer that has a print zone where liquid ink is applied to print media, comprising the steps of:

applying vacuum pressure through a support member for drawing a sheet of print media against the support member;

heating the support member;

conveying the heated support member and the print media sheet through the print zone; and arranging heating elements and vacuum ports on the support member to provide a substantially uniform distribution of heat and vacuum pressure to the sheet of print media that is drawn against the support member.

19. The method of claim 18 wherein the step of heating the support member includes the step of moving the support member across and in contact with a heated member.

20. The method of claim 19 including the step of applying vacuum pressure to the print media while moving the support member across the heated member.

21. The method of claim 20 wherein the step of applying vacuum pressure to the print media includes the step of providing a porous belt as the support member that is moved across the heated member.

22. The method of claim 18 wherein the heating step includes conductively heating the support member.

23. The method of claim 18 including the step of separately heating two portions of the support member.

24. A method of heating print media that is advanced through an ink-jet printer that has a print zone where liquid ink is applied to print media, comprising the steps of:

drawing a sheet of print media against a porous belt by applying vacuum pressure to the print media while moving the belt across and in contact with a heated member;

heating the belt with the heated member; and conveying the heated support member and the print media sheet through the print zone.

25. An apparatus for heating print media in a printer that has a print zone where ink is applied to print media, comprising:

a platen mounted to the printer and having a support surface upon which print media may be supported, the support surface having a print region underlying the print zone, wherein the print region of the support surface is configured to have vacuum ports thereon; and a heater attached to the print region of platen for conducting heat to the print region and thereby to the media as ink is applied to the media in the print zone.

26. The apparatus of claim 25 wherein the print region of the support surface is configured to have a uniform distribution of vacuum ports.

27. The apparatus of claim 26 wherein the heater is attached to the support surface and extends between at least two rows of the uniformly distributed vacuum ports.

28. The apparatus of claim 25 including a porous transport belt of heat-conductive material covering the platen support surface to support and move print media through the print zone.

* * * * *